United States Patent [19]

Estep

[11] Patent Number: 4,930,552

[45] Date of Patent: Jun. 5, 1990

[54] DRAIN STANDPIPE

[76] Inventor: William E. Estep, P.O. Box 314, Powellton, W. Va. 25161

[21] Appl. No.: 420,871

[22] Filed: Oct. 13, 1989

Related U.S. Application Data

[63] Continuation-in-part of Ser. No. 346,626, May 2, 1989.

[51] Int. Cl.[5] ..... D06F 39/08

[52] U.S. Cl. ..... 137/362; 137/593; 137/599; 68/208

[58] Field of Search ..... 137/362, 565, 593, 599; 68/208

[56] References Cited

U.S. PATENT DOCUMENTS

| | | | |
|---|---|---|---|
| 2,049,340 | 7/1936 | Van Der Horst et al. | 137/362 |
| 3,144,759 | 8/1964 | Bochan | 68/208 X |
| 3,407,633 | 10/1968 | Giambertoni | 68/208 X |
| 3,590,606 | 7/1971 | Takeyama | 68/208 |
| 3,871,401 | 3/1975 | Lyons | 137/593 X |

*Primary Examiner*—John Rivell

*Attorney, Agent, or Firm*—Richard C. Litman

[57] ABSTRACT

A washing machine standpipe that has a drainage outlet in Lifting on an inner tube inside the standpipe uncovers a lower opening on the standpipe, allowing trapped water to escape. When the lower opening is in a closed position by having the inner tube cover it, water exits into the standpipe from the top portion as is conventional. The inner tube can be automatically lifted and the lower opening uncovered upon the completion of a machine cycle.

8 Claims, 2 Drawing Sheets

DRAIN STANDPIPE

CROSS-REFERENCE TO RELATED APPLICATION

This present application is a continuation-in-part application of U.S. patent application Ser. No. 07/346,626 filed May 2, 1989.

BACKGROUND OF THE INVENTION

1. Field of the Invention

The present invention relates to drain standpipes, more particularly it is a drain standpipe for a washing machine. Conventional washing machines have a single discharge hose extending from a pump at the bottom of the machine to the open top end of a standpipe. The open end of the standpipe is on level with the maximum water level in the machine tub to prevent overflow. Should the discharge pump break down, water will be trapped in the discharge hose. Even in a normal turned-off situation, water is left in the pipes and hoses, leading to corrosion. To empty the hose, it would have to be disengaged from the top of the standpipe and lowered below the water level so that excess water in the machine can drain out. This is a time-consuming and messy process. The present invention provides means to open a temporary opening in the standpipe below the water level, in order to allow excess water to drain out.

2. Description of the Prior Art

The following patents are felt to be related to the present invention but in no way disclose, singly or in combination, the applicant's unique invention.

U.S Pat. No. 3,091,111 issued to Cruse et al. discloses a control unit for use with a standpipe and washing-machine combination which responds to an overflow condition in the drainage system associated therewith. The control unit is mounted at a particular level on the standpipe and includes a receptacle in which the electric cord for the washing machine is plugged, a pressure-responsive electric switch, a tubular inlet member which extends through an aperture in the standpipe, and an electric energizing cord which is plugged into the outlet. The control unit detects abnormal rises in the water level in the standpipe and responds to such rises by turning off the electric power to the washing machine and/or sounding an audible alarm.

U.S. Pat. No. 3,675,448 issued to Smith discloses a gravity overflow tube to prevent spillage of excess water in an automatic clothes washer. The overflow tube is attached at one end to the top portion of the outer tub of the automatic washer and the other end is connected to a pump and a discharge hose which has an upper curved end received by a standpipe drain. The excess liquid flows through the overflow tube only by the force of gravity.

U.S. Pat. No. 4,069,837 issued to Jirasek discloses an overflow control unit for an automatic washing machine which interconnects the drain hose of the washer to a standpipe. The control unit is positioned within the standpipe of the drainage system and comprises a cylindrical plug device having a central axially extending passageway therethrough and a by-pass valve having an open and a closed position. The by pass valve interconnects the passageway with the atmosphere and responds to an overflow condition in the drainage system to deactivate the washing machine.

SUMMARY OF THE INVENTION

The present invention provides for an easy-to-use mechanical drain for a washing machine standpipe. It comprises an outer standpipe connected to a water level pipe. The water level pipe is connected at two points along an outer pipe, one lower point that serves as the main drain opening, and one higher point that serves as the overflow drainage point. The water level pipe is connected to the discharge hose at its lower end. A cylindrical plug that covers the lower opening is raised to allow water through the lower opening. This plug can be raised automatically by the machine at the end of each of its wash and rinse cycles or it can be raised manually when the machine fails.

A knob on the top of the assembly allows the inner plug to be raised in order to drain water out of the lower opening. Thus much inconvenience is saved from the person who would otherwise have to resort to buckets to drain trapped water from the washing machine.

Accordingly, it is one object of the present invention to provide a washing machine drainage system with two separate openings.

It is another object of the invention to provide a simple mechanically operated second opening for a washing machine drainage standpipe.

It is a further object of the present invention to provide an automatic drainage system for a washing machine that is convenient and easy to use.

These and other objects of the present invention will be readily apparent upon further review of the attached appended drawings, specification and claims.

BRIEF DESCRIPTION OF THE DRAWINGS

Similar reference characters denote corresponding features throughout the drawings.

DESCRIPTION OF THE PREFERRED EMBODIMENT

Figure 1:
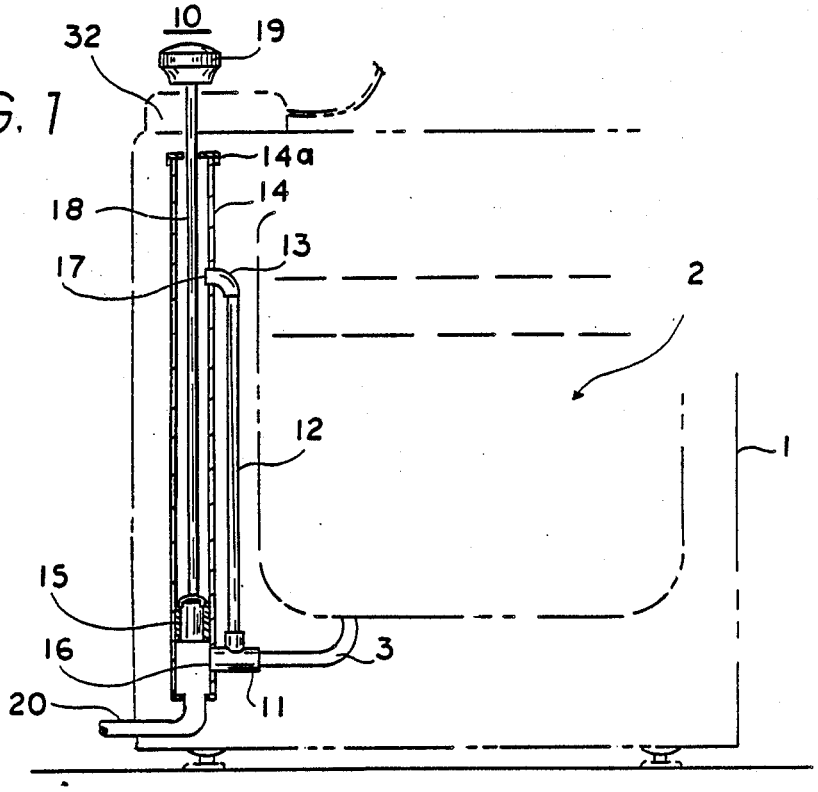
FIG. 1 shows a front view of the standpipe assembly.
Figure 2:
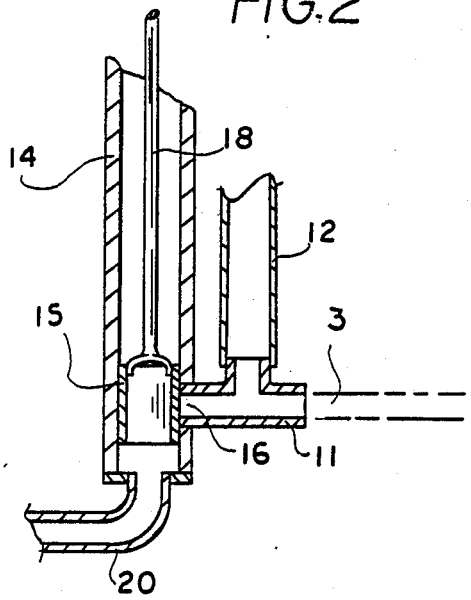
FIG. 2 shows a sectioned view of the standpipe assembly.
Figure 3:
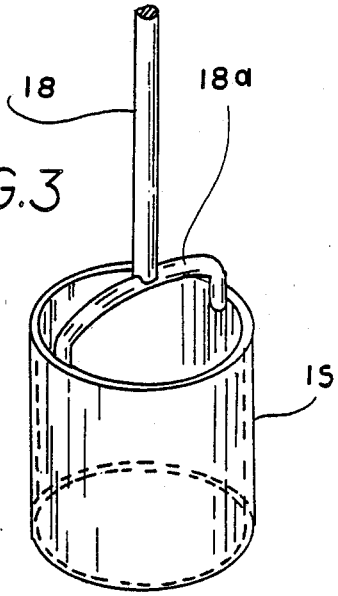
FIG. 3 shows a perspective view of the inner tube that acts as a fluid block and the attached pull rod.
Figure 4:
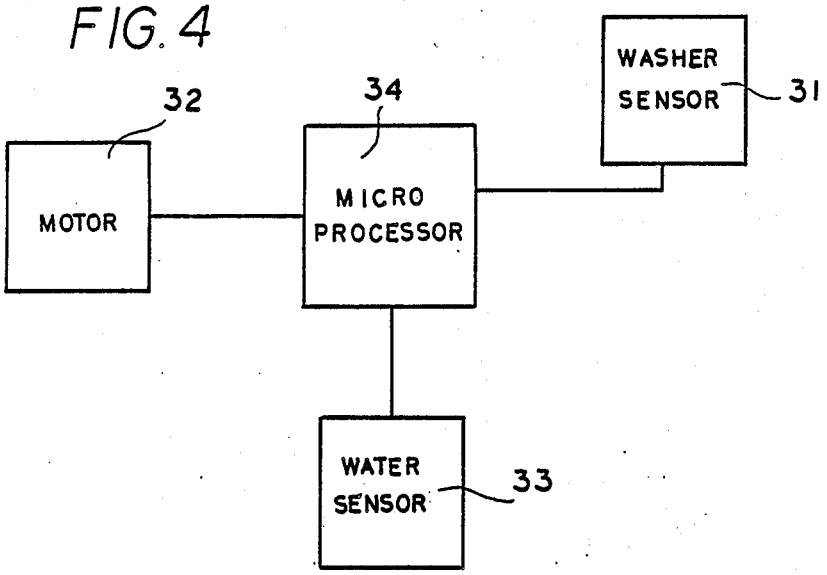
FIG. 4 shows a circuit diagram for the automatic control system.

FIG. 1 shows the standpipe assembly 10 connected to a conventional washing machine 1, with tub 2, and discharge pipe 3. The end of the discharge pipe 3 is mated onto the standpipe assembly 10. The hose attaches to the T-joint 11 of the water level pipe 12. The water level pipe 12 is attached at two distantly separated points to a standpipe tube 14. A lower connection point 16 is part of the T-joint 11, and an upper connection point 17 is part of an L-joint 13 at the upper end of the water level pipe 12 which runs parallel to the standpipe tube 14. Upper connection 17 is at the same height as the overflow height of the washing machine 1.

Water level pipe 12 serves as the drainage route for an overflowing washing machine 1. Water comes through pipe 3 and joint 11 and up through water level pipe 12 to finally exit out of L-joint 13 and down into the standpipe assembly 10 to exit out through drain 20.

Inside the standpipe tube 14 is concentric inner tube 15 which is considerably shorter than the standpipe 14. Inner tube 15 blocks the lower opening 16 to allow normal overflow drainage through upper opening 17 while the washing machine 1 is in usage. Inner tube 15 is slidable within the length of the standpipe tube 14. Rod 18 is attached to the inner tube 15 and proceeds up through the standpipe 14 and cap 14*a* to a knob 19 which can be used to raise or lower the inner tube 15 in order to drain water out of the machine tub 2. The rod 18 has a cross-piece 18*a* that serves to connect the rod 18 to the inner tube 15. The ends of the cross-piece 18*a* would be attached by means of adhesive, nut and bolt or insertion through apertures in the inner tube 15.

The two concentric tubes 14,15 are fitted closely together, but with enough clearance to allow sliding of the inner tube 15 within standpipe tube 14. The seal between the two tubes does prevent water from seeping between them when inner tube 15 is lowered so that opening 16 is covered on the standpipe tube 14. Lifting the inner tube 15, so that opening 16 is uncovered, allows excess water to escape instead of being trapped in pipe 3. Normal washing machines have drainage pumps that pump water up to an opening similar to opening 17. This traps water in the water level pipe 12 and the drainage pipe 3. Draining out the excess water can add life to the machine as a whole by preventing unnecessary corrosion.

Ideally, the assembly 10 is mounted in the cabinet of the washing machine 1 with knob 19 sticking up a few inches over the top of the machine cabinet. This allows for manual access of the lifting rod 18 by the user of the machine 1. This mode of operation would most likely be used when the machine 1 has failed or broken down.

The standpipe assembly 10 can also include fittings for automatic control from the washing machine 1 itself. Sensors 31 on the machine 1 could activate a motor 32 that would lift the rod 19 and the inner tube 15 automatically upon the completion of a wash or rinse cycle. The sensors 31 would detect the shutdown of the machine 1. Such detections would cause commands to be sent through a processor 34 to the motor 32 to operate and lift the tube 15 so as to uncover the lower opening 16, allowing trapped water to drain out. A water sensor 33 could also be placed in hose 3 or pipe 12 to sense the presence of water while the washing machine 1 was not running. A negative command would reclose the lower opening 16,19 by motor 32.

It is to be understood that the present invention is not limited to the sole embodiment described above, but encompasses any and all embodiments within the scope of the following claims.

I claim:

1. A drain standpipe for use with a washing machine, comprising:

a vertically standing elongated hollow outer tube having bottom and opposite ends;

a concentric hollow inner tube slidably mounted inside said outer tube, said inner tube outside surface and said outer tube inside surface forming a close seal;

means to slide said inner tube relative to said outer tube;

two apertures on said outer tube, one of said apertures disposed adjacent a bottom end of said outer tube and the other aperture disposed toward the opposite end of said outer tube, said inner tube normally disposed over said one aperture in order to seal it, but capable of being slid along said outer tube to uncover said one aperture;

a hollow elongated water level pipe, having bottom and opposite ends, mounted exteriorly to said outer tube, each open end of said water level pipe mounted over one of said apertures on said outer tube such that said water level pipe can feed into the interior of said outer pipe.

2. The drain standpipe according to claim 1, including;

a drain affixed to the bottom end of said outer tube, allowing fluid to run off from the interior of said tubes.

3. The drain standpipe according to claim 1, including;

a T-joint on said water level pipe bottom end, one end of said joint mounted over said outer tube one aperture and the other end mounted to a washing machine discharge hose; and an L-joint on said water level pipe opposite end, said L-joint mounted over said outer tube other aperture.

4. The drain standpipe according to claim 1, wherein:

said means to slide said inner tube comprises an elongated rod with opposite ends extending along the length of said outer tube, one of said ends being attached to said inner tube and the other said end disposed adjacent said outer tube opposite end.

5. The drain standpipe according to claim 4, including;

motor means engaging said rod other end, said motor means capable of sliding said inner tube in response to commands from a processor means and sensor means mounted on said washing machine.

6. The drain standpipe according to claim 5, wherein;

said motor means lifts said inner tube to allow fluid to feed through said bottom end aperture when said washing machine stops running.

7. The drain standpipe according to claim 5, wherein;

said motor means lowers said inner tube to close off said bottom apertures when said washing machine is operating.

8. The drain standpipe according to claim 1, wherein:

said inner tube is substantially shorter than said outer tube.

* * * * *